US008471471B2

(12) United States Patent
Eden et al.

(10) Patent No.: US 8,471,471 B2
(45) Date of Patent: Jun. 25, 2013

(54) ELECTRON INJECTION-CONTROLLED MICROCAVITY PLASMA DEVICE AND ARRAYS

(75) Inventors: J. Gary Eden, Champaign, IL (US); Kuo-Feng Chen, Taipei (TW)

(73) Assignee: The Board of Trustees of the University of Illinois, Urbana, IL (US)

( * ) Notice: Subject to any disclaimer, the term of this patent is extended or adjusted under 35 U.S.C. 154(b) by 392 days.

(21) Appl. No.: 12/682,974

(22) PCT Filed: Oct. 27, 2008

(86) PCT No.: PCT/US2008/081318

§ 371 (c)(1), (2), (4) Date: Jul. 14, 2010

(87) PCT Pub. No.: WO2009/055786

PCT Pub. Date: Apr. 30, 2009

(65) Prior Publication Data

US 2010/0289413 A1 Nov. 18, 2010

Related U.S. Application Data

(60) Provisional application No. 61/000,388, filed on Oct. 25, 2007.

(51) Int. Cl.
*H01J 17/49* (2012.01)
*H05H 1/24* (2006.01)

(52) U.S. Cl.
USPC ..... 313/586; 313/231.31; 313/582

(58) Field of Classification Search
USPC ..... 313/484, 485, 582–587, 231.31
See application file for complete search history.

(56) References Cited

U.S. PATENT DOCUMENTS

| | | | |
|---|---|---|---|
| 4,071,334 | A | 1/1978 | Kolb et al. |
| 5,561,348 | A | 10/1996 | Schoenbach et al. |
| 6,016,027 | A | 1/2000 | DeTemple et al. |

(Continued)

FOREIGN PATENT DOCUMENTS

| | | |
|---|---|---|
| WO | WO 2006/130157 | 12/2006 |
| WO | WO 2007/011865 | 1/2007 |

OTHER PUBLICATIONS

Chen, Kuo-Feng et. al., "Scientists fabricate first plasma transistor", PHYSorg.com, Nov. 12, 2008 www.physorg.com/news145705718.html.

(Continued)

*Primary Examiner* — Joseph L Williams
(74) *Attorney, Agent, or Firm* — Greer, Burns & Crain Ltd.

(57) ABSTRACT

An embodiment of the invention is a microcavity plasma device that can be controlled by a low voltage electron emitter. The microcavity plasma device includes driving electrodes disposed proximate to a microcavity and arranged to contribute to generation of plasma in the microcavity upon application of a driving voltage. An electron emitter is arranged to emit electrons into the microcavity upon application of a control voltage. The electron emitter is an electron source having an insulator layer defining a tunneling region. The microplasma itself can serve as a second electrode necessary to energize the electron emitter. While a voltage comparable to previous microcavity plasma devices is still imposed across the microcavity plasma devices, control of the devices can be accomplished at high speeds and with a small voltage, e.g., about 5V to 30V in preferred embodiments.

20 Claims, 5 Drawing Sheets

U.S. PATENT DOCUMENTS

| | | | | |
|---|---|---|---|---|
| 6,051,923 | A | 4/2000 | Pong | |
| 6,139,384 | A | 10/2000 | DeTemple et al. | |
| 6,194,833 | B1 | 2/2001 | DeTemple et al. | |
| 6,239,547 | B1 | 5/2001 | Uemura et al. | |
| 6,538,367 | B1 | 3/2003 | Choi et al. | |
| 6,563,257 | B2 | 5/2003 | Vojak et al. | |
| 6,626,720 | B1 | 9/2003 | Howard et al. | |
| 7,126,266 | B2 | 10/2006 | Park et al. | |
| 2001/0040431 | A1 | 11/2001 | Xu et al. | |
| 2006/0145968 | A1 | 7/2006 | You et al. | |
| 2007/0114929 | A1 | 5/2007 | Son | |
| 2007/0114936 | A1 | 5/2007 | Park et al. | |
| 2008/0129185 | A1 * | 6/2008 | Eden et al. | 313/485 |

OTHER PUBLICATIONS

Chen, Kuo-Feng et. al., "New Plasma Transistor Could Create Sharper Displays", ScienceDaily.com, Feb. 17, 2009 http://www.sciencedaily.com/releases/2009/02/090204131617.htm.

Chiu, Jiann-Jong, et. al., "Organic Semiconductor Nanowires for Field Emission", *Adv. Mater*, 15, No. 16, Aug. 15, 2003.

Lee, C.J., et. al., "Field emission from well-aligned zinc oxide nanowires grown at low temperature", *Applied Physics Letters*, vol. 81, No. 19, Nov. 4, 2002.

Lee, Yun-Hi, et. al., "Tungsten nanowires and their field electron emission properties", *Applied Physics Letters*, vol. 81, No. 4, Jul. 22, 2002.

Park, S.-J., et. al., "Microdischarge Arrays: A New Family of Photinic Devices", *IEEE Journal on Selected Topics in Quantum Electronics*, Jan./Feb. 2002, vol. 8, No. 1.

Park, S.-J., et. al. "Integration of carbon nanotubes with microplasma device cathodes: reduction in operating and ignition voltages", *Electronics Letters*, Apr. 29, 2004, vol. 40, No. 9.

Park, S.-J., et. al., "Carbon nanotube-enhanced performance of microplasma devices", *Applied Physics Letters*, May 31, 2004, vol. 84, No. 22.

Tang, Chengchun et. al. "Effect of BN coatings on oxidation resistance and filed emission of SiC nanowires", *Applied Physics Letters*, vol. 83, No. 4, Jul. 28, 2003.

Wu, Z.S., et. al., "Needle-shaped silicon carbide nanowires: Synthesis and filed electron emission properties", *Applied Physics Letters*, vol. 80, No. 20, May 20, 2002.

Zhou, Jun, et. al., "Large-Area Nanowire Arrays of Molybdenum and Molybdenum Oxides: Synthesis and Filed Emission Properties", *Adv. Mater.*, 15, No. 21, Nov. 4, 2003.

* cited by examiner

ELECTRON INJECTION-CONTROLLED MICROCAVITY PLASMA DEVICE AND ARRAYS

PRIORITY CLAIM AND REFERENCE TO RELATED APPLICATION

This application claims priority under 35 U.S.C. §119 from prior provisional application Ser. No. 61/000,388, which was filed on Oct. 25, 2007.

STATEMENT OF GOVERNMENT INTEREST

This invention was made with government support under Contract No. F49620-03-1-0391 awarded by the U.S. Air Force Office of Scientific Research. The government has certain rights in the invention.

FIELD

A field of the invention is microcavity plasma devices (also known as microplasma devices) and arrays of microcavity plasma devices.

BACKGROUND

Microcavity plasma devices spatially confine a low temperature, nonequilibrium plasma to a cavity with a characteristic dimension d below 1 mm, and as small as 10 μm×10 μm. Researchers at the University of Illinois have developed and demonstrated a range of microcavity plasma devices and arrays of microcavity plasma devices. A number of fabrication processes and device structures have advanced the state of the art and provided devices and arrays in a variety of materials including, for example, semiconductors, ceramics, glass, and polymers. Arrays of microcavity plasma devices that have been developed include addressable arrays. Devices can be operated at high pressures (up to and beyond atmospheric pressure), thus simplifying the requirements for packaging an array. Plasma display panel technology, on the other hand, requires a partial vacuum in the display which requires accordingly sturdy packaging to protect the panels. The various microcavity plasma devices and arrays that have been developed to date have broad utility, with certain ones being especially suited toward one application or another, including for example, general lighting applications, displays (including high definition displays), medical therapeutic procedures, and environmental sensors.

Previous microcavity plasma devices have been turned on and modulated, if modulation was desired, by varying the full voltage across the io device. The RMS value of this voltage is typically 150 V or more. Switching high voltages directly requires relatively expensive driving electronics. Current commercial plasma display panels, which do not use microcavity plasma devices, switch high voltages, for example. The circuitry for switching the high voltages represents a significant cost in the manufacturing of existing plasma televisions, for example. The expense does not arise from the need to apply a high voltage (say, 150 V) to a pixel in a display, but rather from the need to vary it (modulate) quickly in response to a video signal. The need for high speed and high voltage has a serious (negative) impact on the cost of the electronics and the plasma display panel.

Researchers at the University of Illinois have previously developed field emission assisted microcavity plasma devices, which are disclosed in U.S. Pat. No. 7,126,266 (the '266 patent), which issued on Oct. 24, 2006. The field emission nanostructures disclosed in the '266 patent are integrated into microcavity plasma devices or situated near an electrode of microcavity plasma devices and serve to reduce operating and ignition voltages, while also increasing the radiative output and efficiency. The field emission nanostructures in the '266patent include carbon nanotubes and other similar field emission nanostructures, such as nanowires composed of silicon carbide, zinc oxide, molybdenum and molybdenum oxide, organic semiconductors or tungsten. The field emission structures in the '266 patent is they cannot be controlled separately from the microplasma devices themselves. The field emission structures emit electrons as long as the microcavity plasma device is in operation. The inability to readily control nanotube and nanowire electron emission renders these nanostructures of limited value in reducing the voltage necessary to modulate a microplasma device.

SUMMARY OF THE INVENTION

An embodiment of the invention is a microcavity plasma device that can be controlled by a low voltage electron emitter. The microcavity plasma device includes driving electrodes disposed proximate to a microcavity and arranged to contribute to generation of plasma in the microcavity upon application of a driving voltage. An electron emitter is arranged to emit electrons into the microcavity upon application of a control voltage. The electron emitter is an electron source having an insulator layer defining a tunneling region. While a voltage comparable to previous microcavity plasma devices is still imposed across the microcavity plasma devices, control of the devices can be accomplished at high speeds and with a small voltage, e.g., about 5V to 30V in preferred embodiments. The microplasma itself can serve as a second electrode necessary to energize the electron emitter, which permits omission of a top electrode on an emitter used to emit electrons into the microcavity in preferred embodiments.

DETAILED DESCRIPTION OF THE PREFERRED EMBODIMENTS

Figure 1A:
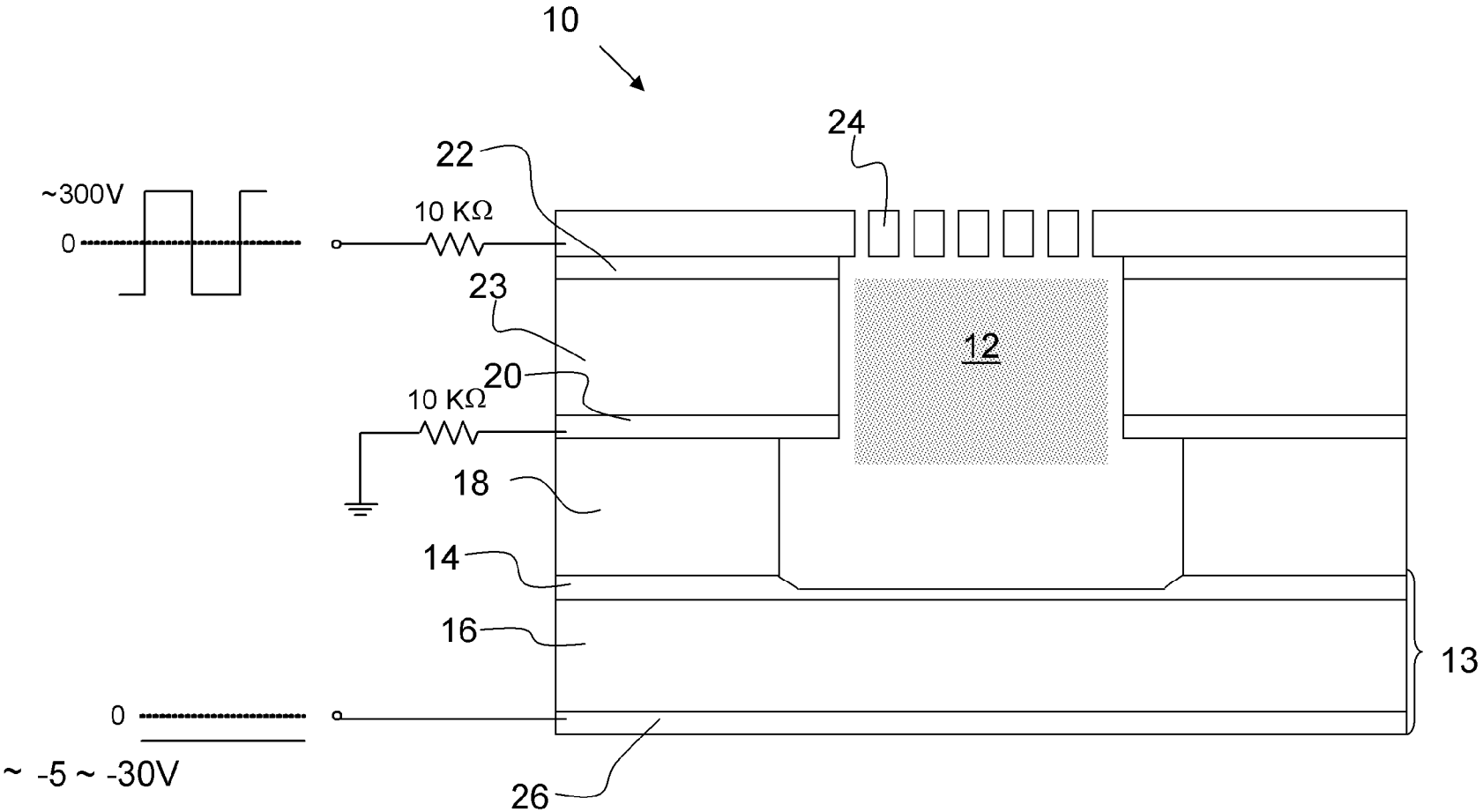
FIG. 1A is a schematic cross-sectional view of an electron injection-controlled microcavity plasma device according to an embodiment of the invention.

Microcavity plasma devices and arrays of the invention are modulated by a controllable electron emitter requiring a substantially smaller voltage than that applied across a microcavity in the device or array to generate a plasma. A driving voltage is applied across microcavity plasma devices while a small control voltage is applied to one or more electron emitters that inject electrons into the microcavity of a device. The effect of electron injection into a microplasma is to increase both the conductance current and light emitted by the plasma. While a voltage comparable to previous microcavity plasma devices is still imposed across the microcavity plasma devices, control of the devices can be accomplished at high speeds and with a small voltage, e.g., about 5V to 30V in preferred embodiments.

An embodiment of the invention is a microcavity plasma device that can be controlled by a low voltage electron emitter. The microcavity plasma device includes driving electrodes disposed proximate to a microcavity and arranged to contribute to generation of plasma in the microcavity upon application of a driving voltage. An electron emitter is arranged to emit electrons into the microcavity upon application of a control voltage. The electron emitter is an electron source having an insulator layer defining a tunneling region. The microplasma itself serves as the second electrode necessary to energize the electron emitter.

Microcavity plasma devices and arrays of the invention have many applications. The devices and arrays are well-suited, for example, to large format and high resolution video displays, where control (modulation) speeds place severe demands on driving electronics. Various microcavity plasma devices and arrays of the invention are driven with an AC or DC driving voltage but they can be also modulated in response to small control voltage, such as a video signal. The control voltage is applied to solid state electron emitter devices located near microcavities of the microcavity plasma devices. The solid state devices act as electron injectors and require only ~5-30 V for operation, permitting the microcavity plasma devices to be switched with a ~5V-30V control voltage. In preferred embodiment microcavity plasma devices and arrays, electron injectors lower the control voltage to below ~10 V, and most preferably sufficiently low to permit transistor-transistor logic (TTL) circuitry generating ~5 V pulses to control microcavity plasma device operation. TTL control of microcavity plasma devices makes large arrays of the devices especially well suited for realizing large and high resolution addressable displays.

Preferred embodiments will now be discussed with respect to the drawings. The drawings include schematic figures that are not to scale, which will be fully understood by skilled artisans with reference to the accompanying description. Features may be exaggerated for purposes of illustration. From the preferred embodiments, artisans will recognize additional features and broader aspects of the invention.

FIG. 1A illustrates a preferred embodiment microcavity plasma device 10. While a single device is illustrated in FIG. 1A, the device can be formed with standard semiconductor and MEMS fabrication techniques and is readily replicated into small and large scale arrays of microcavity plasma devices. The microcavity plasma device 10 includes a microcavity 12 that contains a discharge medium, such as gas, vapors or mixtures thereof Plasma is generated in the microcavity 12, which is spaced away from a controllable tunneling emitter 13 formed of a thin tunneling insulator layer 14 and an electron source 16. A spacer 18 separates the tunneling emitter 13 a distance from the microcavity 12. In preferred embodiments, the spacing is in the range of ~30 μm-100 μm. The electron source 16 can be a semiconductor or metal layer. Upon excitation by a small control voltage, e.g., −5 to −30V across the insulator film 14, electrons tunnel through the thin insulator layer 14 and move toward the microcavity 12. The thickness of the spacer 18 can be optimized to balance competing concerns of protecting the tunneling electron emitter 13 from the plasma and minimizing the distance that electrons must travel to reach the microcavity 12.

Making the spacer 18 as thin as possible is desirable because it minimizes the distance electrons must travel before entering the microcavity 12. A shorter distance of travel translates to stronger control of the microplasma but also a shorter delay time between when the control voltage is applied and an effect of the injected electrons on the microplasma is observed. However, bringing the emitter 13 closer to the plasma increases the potential for damaging the electron emitter 13. In a preferred embodiment, a ~70 μm thickness for the spacer 18 was found to be effective for test devices having the FIG. 1 structure. This distance will change with other structures, and will be reduced with more robust emitters. It should be noted that electron emitters of the types illustrated in FIGS. 1A, 1B, 1C, and 2A generally require a thin metal electrode on top of the tunneling insulator layer. However, it has been found in experiments with the device of FIG. 1A that this metal electrode is not necessary and, in fact, is not shown in FIG. 1A. Instead, the sheath region associated with the microplasma produced in microcavity 12 will serve as an electrode. The advantage of dispensing with the top electrode of emitter 13 is that the emission current injected into the microplasma is larger than would otherwise be the case.

The microcavity plasma device further includes driving electrodes 20, 22 separated by a dielectric 23. Additionally, a screen electrode 24 is illustrated, and can be used to improve radiative efficiency. It should be emphasized that the screen electrode 24 is not necessary for the functioning of the invention. The driving voltage shown in FIG. 1A could simply be applied to electrode 22. The electrodes 20, 22, and 24, as well as an electrode 26 to drive the emitter 13, can be part of a circuit interconnect pattern in an array of microcavity plasma devices. Devices in arrays can be individually addressed via electrode 26 of the electron emitter with small, e.g. 5-30V, voltages.

Figure 1B:
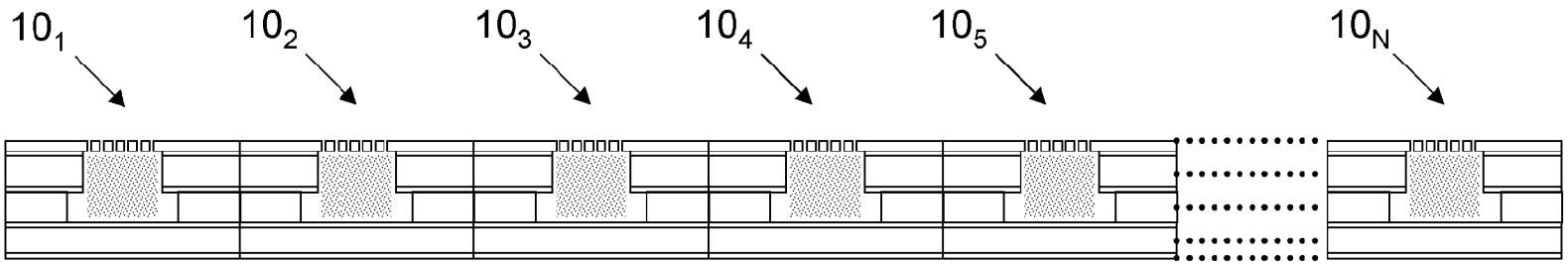
FIG. 1B is a schematic cross-sectional view of an array of electron injection-controlled microcavity plasma devices according to an embodiment of the invention.

FIG. 1B illustrates a portion of an array of microcavity plasma devices of the invention. Individual microcavity plasma devices $\mathbf{10}_1$-$\mathbf{10}_N$ in the array of FIG. 1B are formed in accordance with the microcavity plasma devices of FIG. 1A. The electrodes 20 and 22 in the array of FIG. 1B can be patterned in a circuit interconnection pattern in accordance with standard semiconductor and MEMS fabrication techniques.

The invention is also applicable to other microcavity devices and arrays formed by semiconductor fabrication processes. Exemplary microcavity plasma devices and arrays that could be modified to include electron injection control of the invention are disclosed in the following US patents and applications that are incorporated by reference: U.S. Pat. No. 7,112,918 to Eden , et al. issued Sep. 26, 2006, and entitled Microdischarge Devices and Arrays Having Tapered Microcavities; U.S. application Ser. No. 11/042,228, filed Jan. 25, 2005, entitled AC-Excited Microcavity Discharge Device and Method; U.S. Published Application No. 20050269953, entitled Phase-Locked Microdischarge Array and AC, RF or Pulse Excited Microdischarge.

Figure 1C:
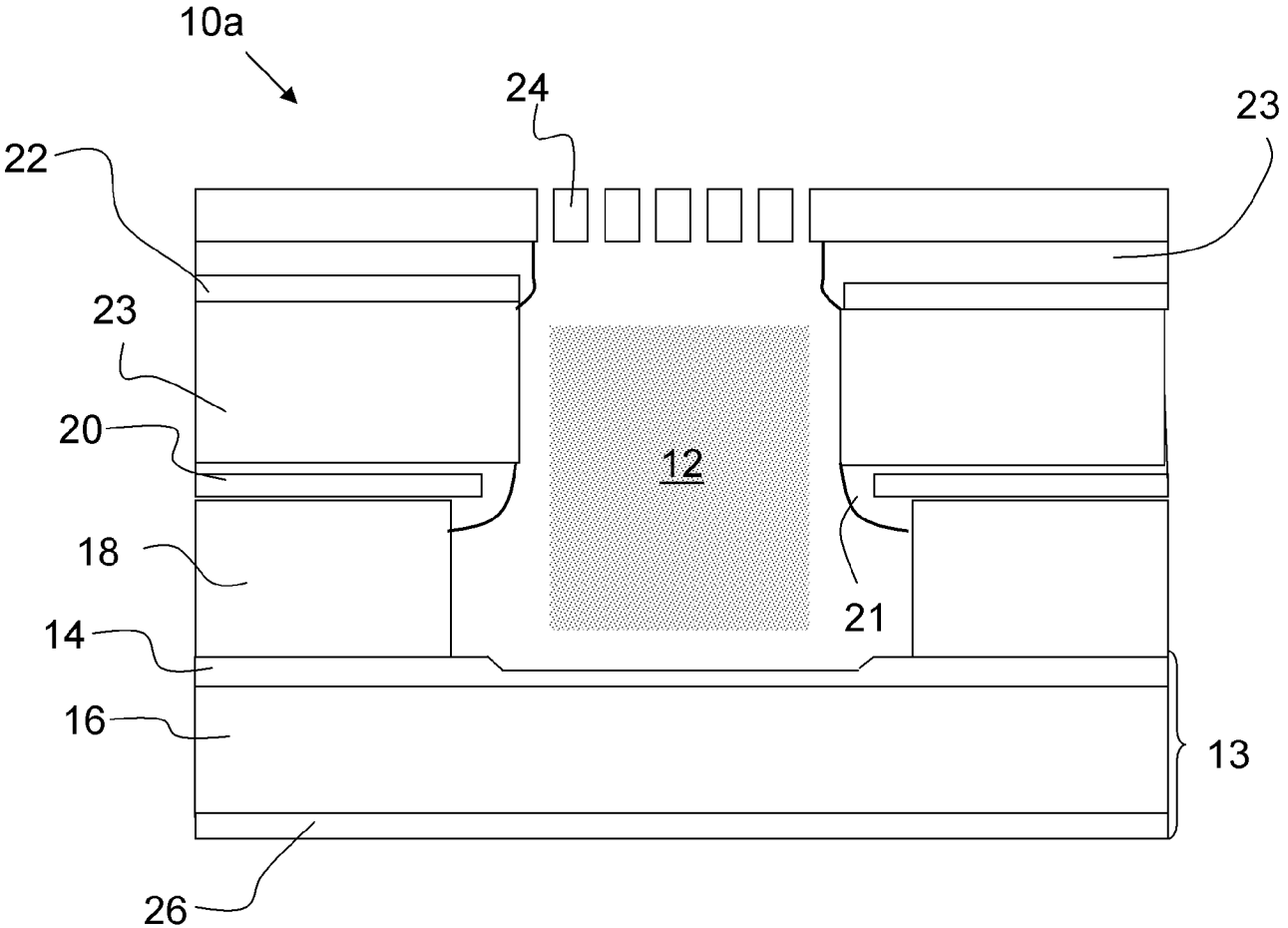
FIG. 1C is a schematic cross-sectional view of an electron injection-controlled microcavity plasma device according to another embodiment of the invention.

FIG. 1C illustrates an example microcavity plasma device 10*a* of the invention in which the driving electrodes 20 and 22 are protected by dielectric layers 21 and 23. The plasma device 10*a* is driven by a time varying voltage, and the layers 21 and 23 protect the electrodes 20 and 22 from the plasma. The dielectric increases operational lifetime of the device as compared to the device of FIG. 1A.

In the preferred embodiment devices of FIGS. 1A-1C, the tunneling electron emitter 13 is a quasi-Schottky-type structure. The term "quasi-" is used because this simple emitter comprises only a thin metal film 26 at the backside for connection purposes, a semiconductor region 16 (n-Si in a preferred embodiment), and a very thin dielectric film 14. Other types of tunneling electron emitters can be used such as metal-insulator-metal (MIM) tunneling emitters.

Figure 2A:
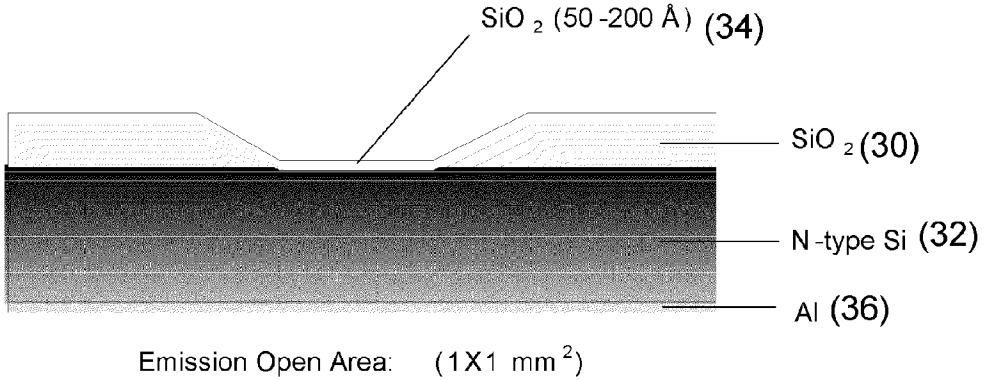
FIGS. 2A and 2B are schematic cross-sectional diagrams illustrating alternative metal oxide semiconductor and metal insulator metal emitters that can be used in electron injection-controlled microcavity plasma devices and arrays of the invention.
Figure 2B:
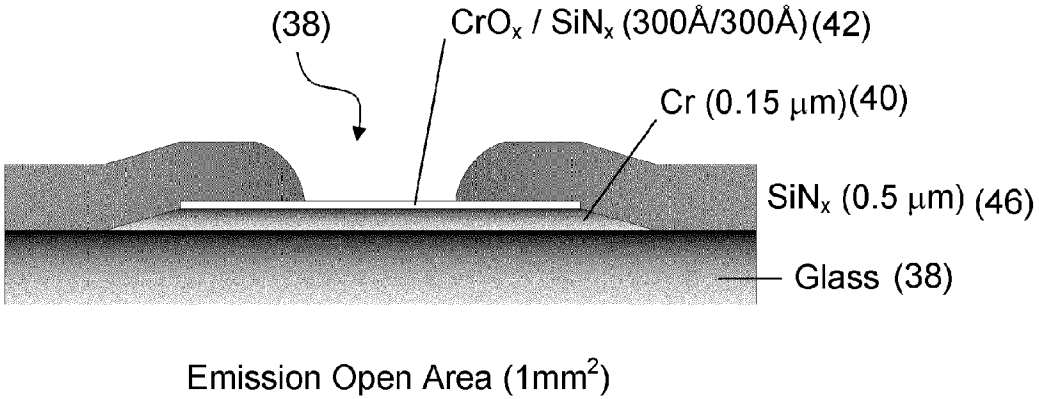

FIGS. 2A and 2B show alternative tunneling electron emitters that can be used as the electron emitter shown in FIGS. 1A-1C to provide electrons directed into the microcavities to control the microcavity plasma devices. FIG. 2A shows a quasi-MOS tunneling emitter and FIG. 2B shows an alternative MIM (metal-insulator-metal) structure. FIGS. 2A and 2B also illustrate typical dimensions for the tunneling emitters, while artisans will recognize that the dimensions merely provide an example embodiment, and emitters having different dimensions and different structures that are known can also be used for the tunneling electron emitter shown in FIGS. 1A-1C. In the fabrication of the quasi-MOS device of FIG. 2A, dielectric 30 (e.g., $SiO_2$) is formed on a semiconductor 32 (e.g., n-type Si). The dielectric is thinned to form a tunneling region 34, which in the example is about 50-200 Å in thickness and about 1 $mm^2$ in area. A thin metal film 36, e.g., of aluminum, serves as a contact and completes the device. The simple electron emitters of FIG. 2 minimize fabrication costs but other more complex electron emitters can also be used, some of which can provide higher electron emission efficiency.

FIG. 2B illustrates a quasi-MIM tunneling emitter that is formed on a dielectric substrate 38, e.g., glass. The electron source is a thin metal layer 40, e.g., chromium and the tunneling barrier 42 is a very thin layer of dielectric or multiple thin layers of dielectric, such as a bilayer of $CrO_x$ and $SiN_x$. Additional dielectric 46, e.g., $SiN_x$, defines emission region 48.

Figure 3:
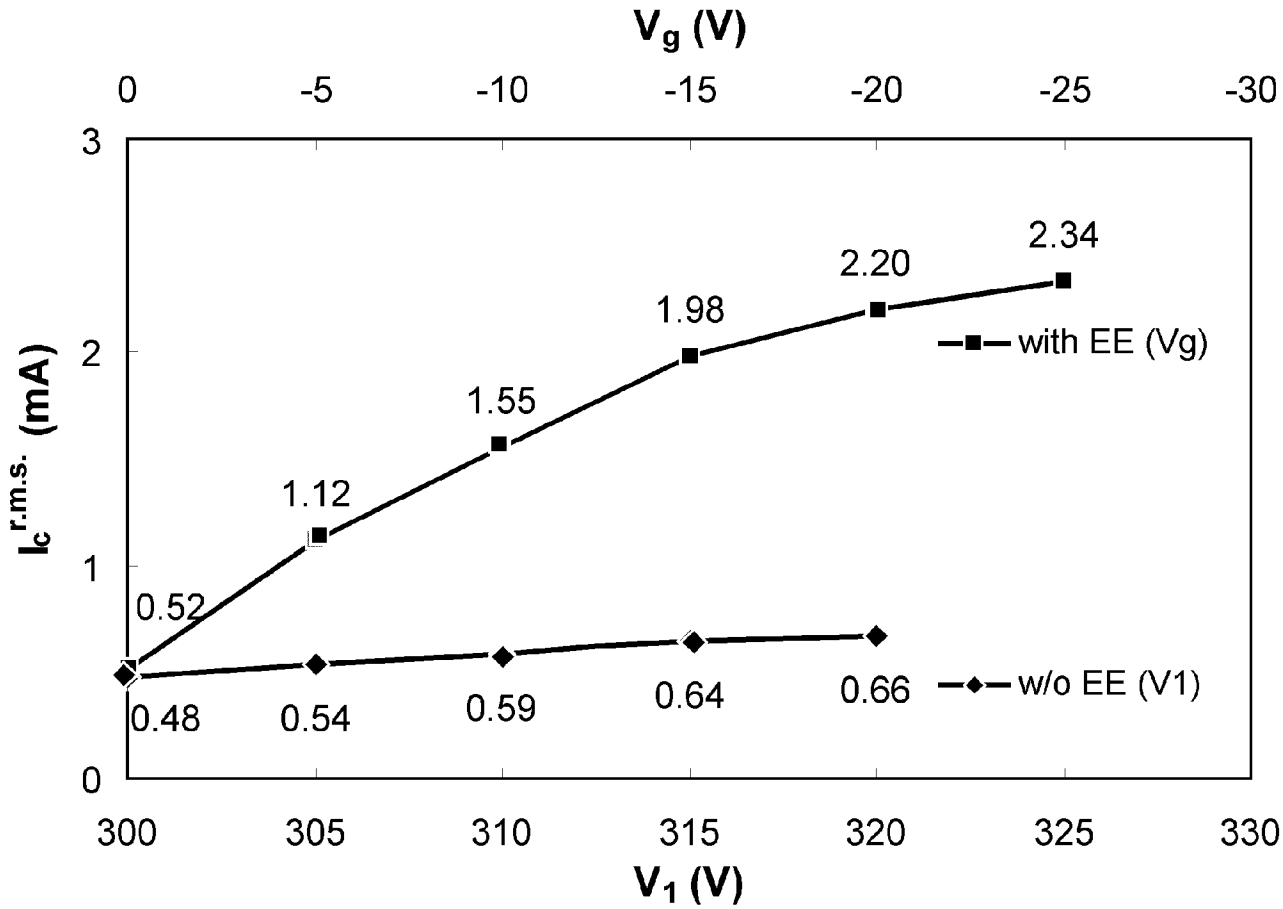
FIG. 3 illustrates performance data for an experimental microplasma device in accordance with FIG. 1A that shows the device can be controlled with a small voltage applied to the electron emitter.

An experimental device consistent with the FIG. 1A device was constructed and tested. All data were taken for 300 Torr of Ne in the microcavities and the bipolar voltage waveform shown in FIG. 1A drove the top electrode 22 and screen electrode 24 through a resistor. For these tests, the emitter 13 was biased with a negative DC voltage as shown in FIG. 1A. Measured current and fluorescence intensity waveforms showed a strong dependence on electron injection by the electron emitter, indicating that the microplasmas generated in microcavity 12 are controllable by a small voltage applied to the electron emitter. Discharge current and light output rise dramatically when the tunneling electron emitter is turned on with a small voltage. The tests showed that the electron injection by the tunneling electron emitter can be responsible for virtually all of the conduction current even though the maximum voltage applied to the tunneling electron emitter was no more than ~8% of the driving voltage applied to the microcavity plasma device. As seen in the summary data presented in FIG. 3, with a voltage of just 20V ($V_g$) applied to the tunneling emitter (see "with EE(electron emitter)" curve), the discharge conduction current is more than triple the value measured without electron ejection (without EE). A substantial difference is present at even 5V, with the emission intensity more than doubling as a result of electron injection, indicating that standard microcircuit control voltages can be used to control plasma generation. Emission intensities from the microcavity plasma device show similar dependence upon the electron injection from the electron emitter.

While specific embodiments of the present invention have been shown and described, it should be understood that other modifications, substitutions and alternatives are apparent to one of ordinary skill in the art. Such modifications, substitutions and alternatives can be made without departing from the spirit and scope of the invention, which should be determined from the appended claims.

Various features of the invention are set forth in the appended claims.

The invention claimed is:

1. A microcavity plasma device, comprising:

a microcavity in material;

driving electrodes disposed proximate to said microcavity and arranged to contribute to generation of plasma in the microcavity upon application of driving voltage;

an electron emitter including a dielectric film through which electrons tunnel to enter said microcavity.

2. The device of claim 1, wherein said dielectric film is spaced at a predetermined distance from said microcavity to protect the emission region from plasma generated in said microcavity.

3. The device of claim 2, wherein said predetermined distance is 30-100 μm.

4. The device of claim 3, wherein said electron emitter comprises:

an electron source region, a dielectric layer defining the tunneling region;

wherein the tunneling region and the microcavity are arranged such that electrons are emitted into the microcavity upon application of the control voltage.

5. The device of claim 4, further comprising dielectric to isolate said driving electrodes from said microcavity.

6. The device of claim 1, wherein said electron emitter comprises:

an electron source region, a dielectric layer defining the tunneling region;

wherein the tunneling region and the microcavity are arranged such that electrons are emitted into the microcavity upon application of the control voltage.

7. The device of claim 6, further comprising dielectric to isolate said driving electrodes from said microcavity.

8. An array of microcavity plasma devices comprising a plurality of microcavity plasma devices according to claim 7.

9. The device of claim 1, wherein said electron emitter comprises a semiconductor/oxide film electron emitter having the oxide film tunneling region arranged such that electrons are emitted into the microcavity upon application of the control voltage.

10. The device of claim 9, wherein said tunneling region is disposed ~30-100 μm from said microcavity.

11. The device of claim 9, further comprising dielectric to isolate said driving electrodes from said microcavity.

12. An array of microcavity plasma devices comprising, a plurality of microcavity plasma devices according to claim 9.

13. The device of claim 1, wherein said electron emitter comprises a metal/insulator film electron emitter having a tunneling region arranged such that electrons are emitted into the microcavity upon application of the control voltage.

14. The device of claim 13, wherein said tunneling region is disposed ~30-100 μm from said microcavity.

15. The device of claim 13, further comprising dielectric to isolate said driving electrodes from said microcavity.

16. An array of microcavity plasma devices comprising a plurality of microcavity plasma devices according to claim 15.

17. An array of microcavity plasma devices comprising a plurality of microcavity plasma devices of claim 1.

18. A microcavity plasma device, comprising:

microcavity plasma means for producing and containing a plasma in a microcavity defined by the microcavity plasma means; and electron emitter means for controlling the plasma by the controlled injection of electrons into the microcavity.

19. A method for controlling a microcavity plasma device, the method comprising steps of:

applying a driving voltage to a microcavity plasma device;

controlling plasma in the microcavity plasma device with the controlled injection of electrons from an electron emitter into a microcavity of the plasma device with a control voltage that is substantially smaller than the driving voltage.

20. The method of claim 19, wherein said control voltage is within the range of approximately 5 to 30V.

* * * * *

UNITED STATES PATENT AND TRADEMARK OFFICE

CERTIFICATE OF CORRECTION

PATENT NO. : 8,471,471 B2
APPLICATION NO. : 12/682974
DATED : June 25, 2013
INVENTOR(S) : J. Gary Eden et al.

It is certified that error appears in the above-identified patent and that said Letters Patent is hereby corrected as shown below:

In the Specification:

Col. 1, line 51 Before "device" please delete "io".

Col. 3, line 56 After "thereof" please insert a --.--.

Col. 4, line 51 After "7,112,918 to" please delete "Eden ," and insert --Eden,-- therefor.

In the Claims:

Col. 6, line 22 After "source region" please delete the "," and insert a --;-- therefor.
Claim 4

Col. 6, line 31 After "source region" please delete the "," and insert a --;-- therefor.
Claim 6

Signed and Sealed this
First Day of October, 2013

Teresa Stanek Rea
*Deputy Director of the United States Patent and Trademark Office*